US006942100B2

(12) United States Patent
Su

(10) Patent No.: US 6,942,100 B2
(45) Date of Patent: Sep. 13, 2005

(54) SQUARE BOTTOMED PLASTIC BAG STACK AND METHOD OF MAKING SAME

(76) Inventor: Frank Su, 12850 Midway Pl., Cerritos, CA (US) 90703

( * ) Notice: Subject to any disclaimer, the term of this patent is extended or adjusted under 35 U.S.C. 154(b) by 15 days.

(21) Appl. No.: 10/779,501

(22) Filed: Feb. 13, 2004

(65) Prior Publication Data

US 2005/0139508 A1 Jun. 30, 2005

(51) Int. Cl.[7] ..... B65D 33/01

(52) U.S. Cl. ..... 206/554; 383/9; 383/37; 383/103

(58) Field of Search ..... 206/554; 383/9, 383/10, 37, 103

(56) References Cited

U.S. PATENT DOCUMENTS

| | | | | |
|---|---|---|---|---|
| 3,687,278 | A * | 8/1972 | Graham et al. | 206/554 |
| 3,777,439 | A * | 12/1973 | Fried | 206/554 |
| 3,782,073 | A * | 1/1974 | Musser | 206/554 |
| 3,942,416 | A | 3/1976 | Ackley et al. | |
| 3,967,544 | A | 7/1976 | Brock et al. | |
| 3,988,970 | A | 11/1976 | Hanson et al. | |
| 4,526,565 | A | 7/1985 | Hummel et al. | |
| 4,566,927 | A | 1/1986 | Wood | |
| 4,655,737 | A | 4/1987 | Benoit | |
| 4,685,276 | A | 8/1987 | Kiel | |
| 4,717,262 | A | 1/1988 | Roen et al. | |
| 4,848,930 | A | 7/1989 | Williams et al. | |
| 4,911,561 | A | 3/1990 | Wagner | |
| 5,102,383 | A | 4/1992 | Achelpohl et al. | |
| 5,135,464 | A | 8/1992 | Buchanan | |
| 5,273,362 | A | 12/1993 | Buchanan | |
| 5,335,788 | A * | 8/1994 | Beasley et al. | 206/554 |
| 5,741,077 | A | 4/1998 | Sasaki et al. | |
| 5,954,432 | A | 9/1999 | Laudenberg | |
| 6,042,526 | A | 3/2000 | Baumer | |
| 6,056,681 | A | 5/2000 | Ross | |
| 6,095,687 | A | 8/2000 | Dematteis | |
| 6,113,269 | A | 9/2000 | DeMatteis et al. | |
| 6,254,521 | B1 | 7/2001 | Pansier et al. | |
| 6,286,681 | B1 | 9/2001 | Wilfong, Jr. et al. | |
| 6,319,184 | B1 | 11/2001 | DeMatteis et al. | |
| 6,394,309 | B1 * | 5/2002 | Fainberg | 206/554 |
| 6,561,963 | B2 | 5/2003 | Totani | |
| 6,575,301 | B2 * | 6/2003 | Simhaee | 206/554 |

* cited by examiner

*Primary Examiner*—Luan K. Bui
(74) *Attorney, Agent, or Firm*—David A. Belasco; Belasco Jacobs & Townsley, LLP

(57) ABSTRACT

A square bottom plastic bag is designed to stand upright when opened. The bags are constructed with open tops, side handle openings and attached headers or with t-shirt style handles. The bags are produced in registered bag stacks and include means for adhering a rear surface of one bag to a front surface of a subsequent bag to make the bags self-opening when used with a dispensing rack. The headered bags have tear-off headers or headers with weakened areas that will rupture upon dispensing. The t-shirt bags have apertures through the handles to suspend the bags on a rack or a header attached above the handles. The bags have detachable or rupturable center tabs. The bags are registered with hot pins or cold stakes through an upper portion of the bags or bag handles. The bags have openings, microperforations, or are formed of porous material to dissipate heat or moisture.

27 Claims, 9 Drawing Sheets

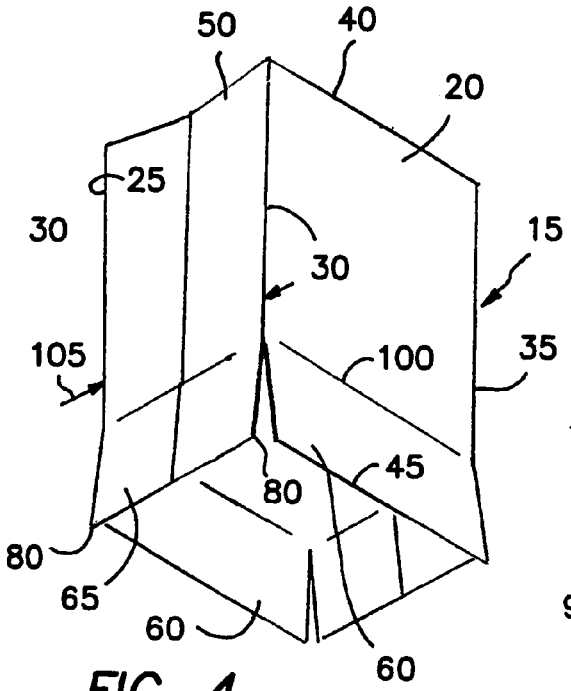
FIG. 4
FIG. 5
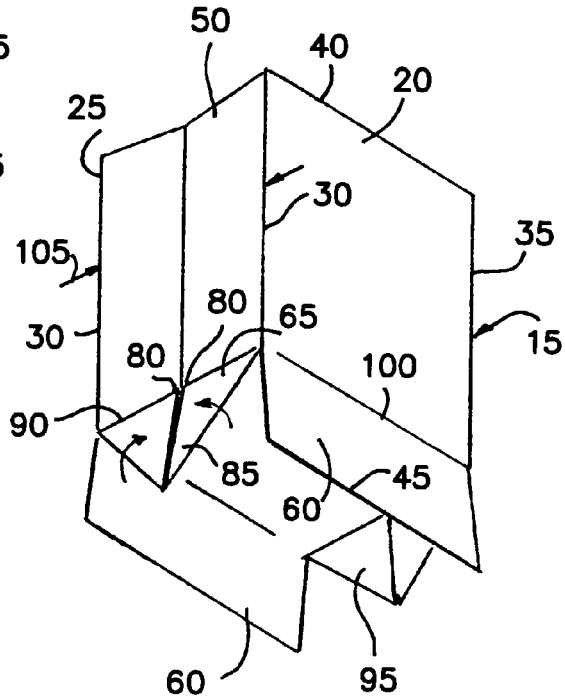
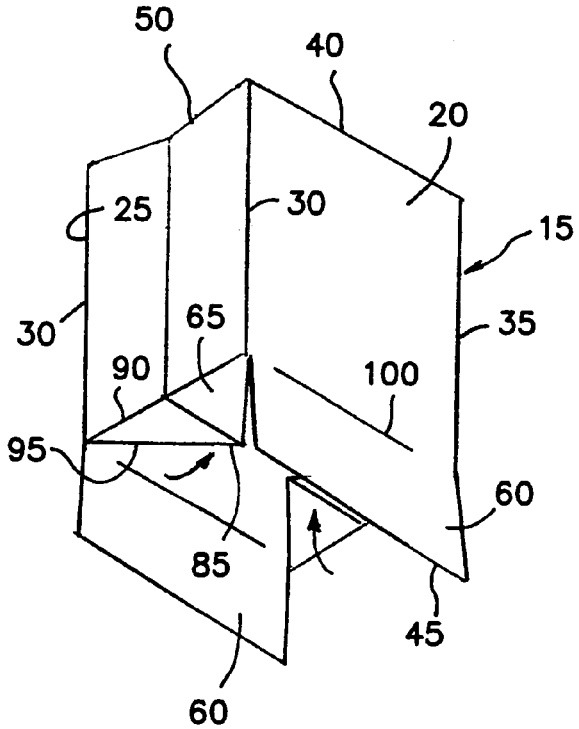
FIG. 6
FIG. 7
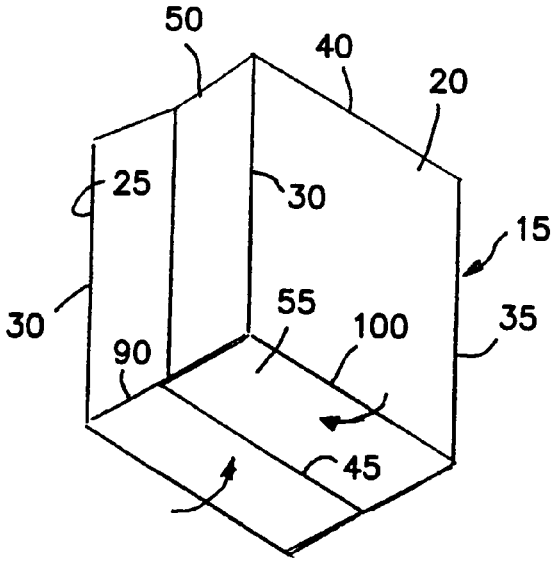

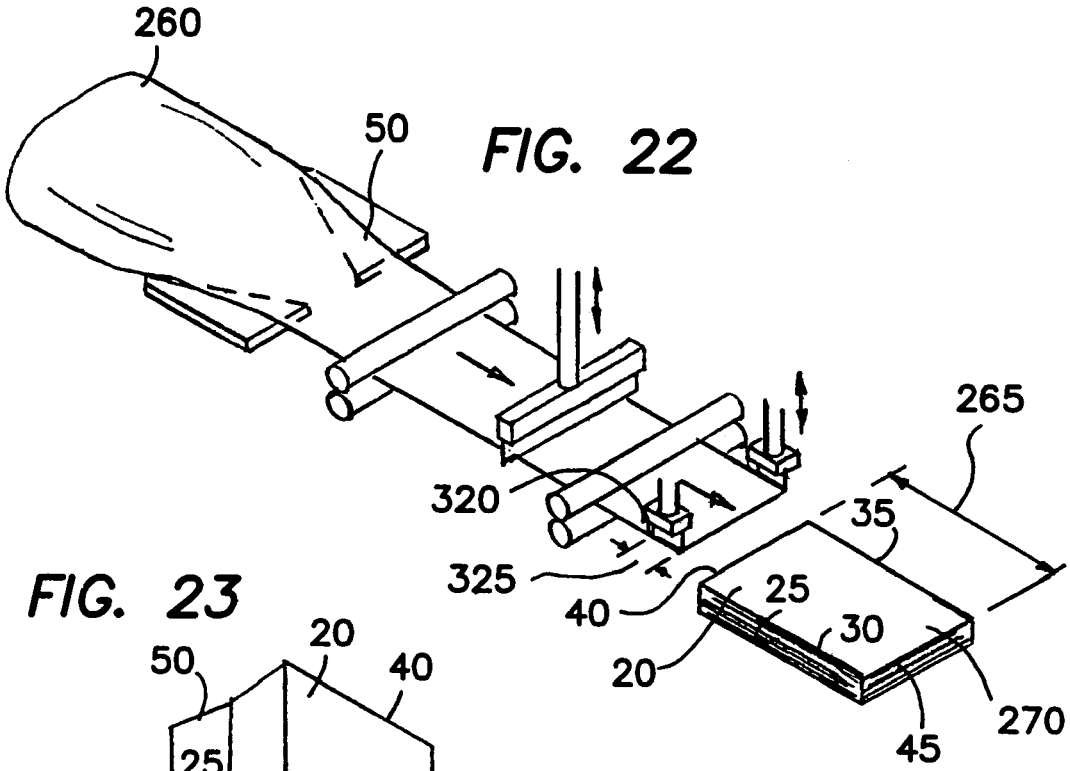
FIG. 22
FIG. 23
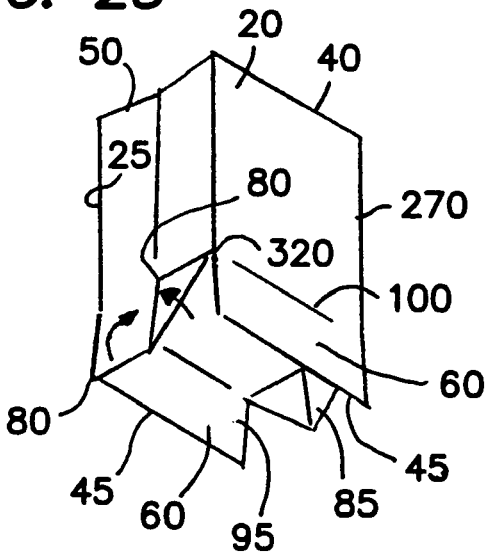
FIG. 24
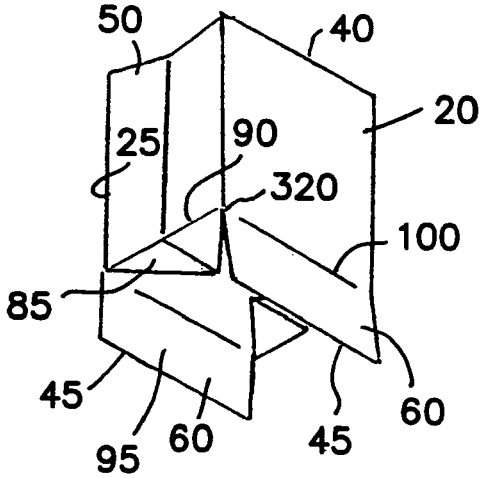
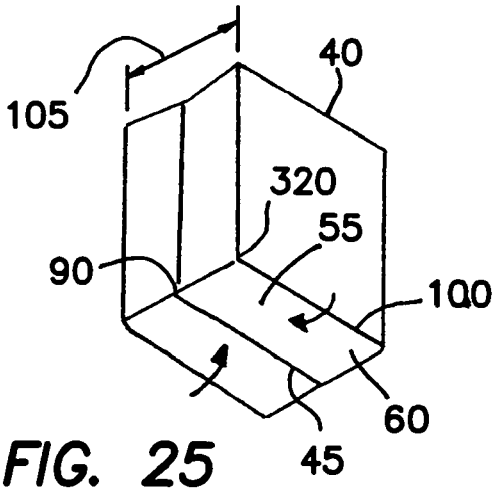
FIG. 25
FIG. 26
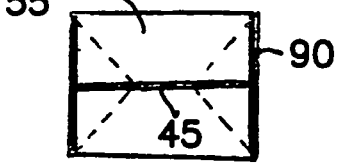

155
170
370
160
75
20
25
140
120
145
130
135
365
15
165
175

SQUARE BOTTOMED PLASTIC BAG STACK AND METHOD OF MAKING SAME

FIELD OF INVENTION

The invention pertains to plastic bags and methods of manufacturing them. More particularly, the invention relates to square bottomed bag stacks supplied with a detachable header portion for suspending the bag stack as well as t-shirt style handle bags.

BACKGROUND OF THE INVENTION

Plastic bags have replaced paper bags for many applications in recent years based upon the ease and economics with which they can be manufactured. However, at present, paper bags are still favored for certain applications. Paper bags can easily be constructed with a completely flat bottom and can be made to stand up without a supporting rack both when empty and when filled. Also, paper bags tend to be somewhat porous and "breathable" and thus more desirable for use with items such as hot food products. For these reasons, paper bags have dominated such industries as fast food delivery and other applications in which it is important to be able to easily position articles within the bag. Paper bags, on the other hand, have other problems. For example, strong handles are not easily attached to paper bags, the bags become weakened with moisture, they are heavy, bulky and require wood as raw material. Plastic bags, on the other hand, are more durable, more compact and light weight, stronger, impervious to moisture and can easily be made with strong handles.

Various designs have been developed in attempts to provide a practical, breathable, square bottomed plastic bag that will stand up when opened for filling and remain upright when filled. U.S. Pat. No. 6,286,681 issued to Wilfong, Jr. et al. is directed to a ventilated plastic bag embodying closely spaced micro-perforations that extend through the wall sections to provide ventilation to the interior food carrying area. These perforations allow the bag to be used for carrying hot food items without weakening the strength regions of the bag. The closed bottom area of the bag may be formed by heat-sealing of the film material, but may also include corner or angle seals to define a square bottom on the bag.

U.S. Application Publication No. 2002/0110290 by Gebhardt discloses a plastic bag with randomly placed arcurate vent pairs. The bags described in this publication are made from a plastic tubing or sheeting stock. The bag may also include a handle aperture and the bag may include square-bottomed seals on gusseted bags. In the preferred embodiment of the receptacle described, vents are cut into the material of the receptacle that can accommodate, store, and transport fresh hot foods to provide a breathable element desired for the bags.

U.S. Pat. No. 6,319,184 issued to DeMatteis is directed to an apparatus and process for producing cold seal in plastic bags. The bags described may be of a semi-flat-bottom type and may have hand holes to form handles in the upper portion of the bags. U.S. Pat. No. 6,113,269 issued to DeMatteis discloses an automatic ventilating system for plastic bags. U.S. Pat. No. 6,095,687 issued to DeMatteis is directed to a flat bottomed plastic bag having a handle aperture. The bag described sits upright upon a bottom gusset.

U.S. Pat. No. 5,149,201 issued to Benoit discloses a bag structure of a thermoplastic film material comprising front and rear bag walls connected by side walls and having an open mouth top portion, said open mouth portion being characterized by having handles located at opposite end regions thereof, said handles being of two films as a result of being integral extensions of said front rear and gusseted side walls, said bag having a bottom wall planarly extensible so as to form a rectangle with at least no substantial excess film outside of the bulk volumetric capacity of said bottom region of said bag. This invention also provides a method and system for preparing flat bottom thermoplastic sacks comprising process steps and means for forming a tube of thermoplastic film, collapsing said tube while forming two oppositely disposed gussets therein, forming two pairs of diagonal sealed seams in the gussets, forming a transverse sealed seam across the tube along a line which includes the inboard ends of the diagonal seams and forming pre-weakened transverse lines closely adjacent to said transverse sealed seam or forming a severing line along this line, removing the four double triangular regions bounded by the diagonal seams, the transverse seams and the side edges of the tube and collecting the resulting structures either while still interconnected or by stacking the severed sacks. The final structure can have handles or it can be handleless.

U.S. Pat. No. 5,165,799 issued to Wood describes flexible square bottom bags which include side gusset panels having central inwardly oriented fin seams and which are sealed adjacent their lowermost corners to portions of the front and rear panels of the bags and wherein the entire width of the lowermost edges of the front and rear panels are sealed to thereby form bags having bottoms reinforced by triangular gusset seals at each corner and which have an outwardly oriented transverse bottom fin seam when erected.

U.S. Pat. No. 5,362,152 issued to Fletcher et al. describes a T-shirt type plastic bag adapted for carrying hot foods from fast food restaurants. The bag includes front and rear wall sections, gussetted side wall sections integrally connecting the front and rear wall sections together and means connecting the bottoms of the front, rear and gussetted side wall sections together to define a closed bottom. At least a part of the front and rear wall sections are open at the tops to define a mouth portion. Laterally spaced handles are integral with the front, rear and gussetted side wall sections and extend upwardly from opposed sides of the mouth portion. Apertures extend through at least one of the wall sections for providing a path for a venting air flow from the outside of the bag and through the inside of the bag when the bag is carrying hot food.

U.S. Pat. No. 5,102,384 issued to Ross et al. discloses a method of constructing a flat bottom in a plastic film tube having an open upper end, a closed lower end formed by a transverse seal, forward and rearward sides and a pair of opposing pleated sides that interconnect the forward and rearward sides. The method includes the steps of releasably engaging a lower vacuum and a lower clamp with a transverse section of the rearward side of the tube to provisionally hold the transverse section. A lateral section of the forward side is gripped and raised by an upper vacuum and an upper clamp to expose a portion of the pleated sides such that first and second pockets are formed, respectively, in the sides. The sealed lower end is drawn toward the upper end to fold the tube along first and second transverse fold lines in the forward side, along a third transverse fold line in the transverse section of the rearward side, and along fourth and fifth fold lines, respectively, in the pleated sides such that the first and second pockets are located in the pleated sides, respectively between the first and third fold lines and the lower end of the bag. Pressure is applied to the tube to form creases along the first, third, fourth and fifth fold lines, which define the perimeter of the flat bottom of the tube.

U.S. Pat. No. 5,549,538 issued to Marsik describes a process for manufacturing a multi-ply square bottom bag having a front wall, a back wall, a pair of gusseted side walls, each of which join to said front and back walls. There is also formed a gusseted square bottom panel having spaced but substantially parallel gusset edges and said bottom is joined to the front, back and side walls. The bag is produced by providing a web of inner ply material and a web of outer ply material, adhesively joining said webs into a composite and forming said bag from said joined webs. The improvement relates to forming a first flap in the inner web by cutting the web so as to form a plurality of free edges and a hinge line for said flap. The hinge line is connected to the free edges so that the free edges and hinge line define the flap. Thereafter joining the inner and outer webs to form the composite web. The hinge line is generally transverse to the longitudinal axis of the web and the flap is formed in the inner web so as to be positioned adjacent the front wall and bottom wall with the hinge line at the junction thereof when said bag is formed and said flap is arranged to overlie the gusset edges in the bottom panel.

It is an objective of the present invention to provide a registered bag stack with attached headers for suspension from a dispensing rack. It is an additional objective to provide a registered bag stack with integral t-shirt style handles formed in an upper portion of the bag. It is a further objective to provide square bottomed bags that will remain upright when opened in filled or unfilled condition. It is a still further objective of the invention to provide a breathable or ventilated bag suitable for use with hot food or similar items. It is yet a further objective to provide a bag stack that has the above-described features that is easily and inexpensively manufactured.

While some of the objectives of the present invention are disclosed in the prior art, none of the inventions found include all of the requirements identified.

SUMMARY OF THE INVENTION

The present invention addresses all of the deficiencies of prior art square bottom bag stack inventions and satisfies all of the objectives described above.

(1) A square bottomed plastic bag stack providing the desired features may be constructed from the following components. A plurality of stacked polyethylene film bags is provided. Each of the bags includes front and rear polyethylene film walls. Each of the front and rear walls have first and second side edges, a top edge and a bottom edge. Each of the bags has a pair of longitudinally oriented side gussets attached to the first and second side edges. Each of the bags has a flat, rectangular bottom formed of lower portions of the front and rear walls and lower portions of the side gussets. Each of the bags is folded inwardly at the side gussets and upwardly from either the front wall or the rear wall at a point spaced upwardly from the bottom edge, to form a flattened bag. The bags are stacked upon one another and held in registration by attachment of the bags to one another, thereby forming a registered bag stack. Each of the bags is attached at the top edges of at least one of the front and rear walls to at least one header strip. When the bags are pulled from the bag stack and opened, they will stand erect upon the flat bottom.

(2) In a variant of the invention, a plurality of stacked polyethylene film bags is provided. Each of the bags includes front and rear polyethylene film walls. Each of the front and rear walls has first and second side edges, a top edge and a bottom edge. Each of the bags has a pair of longitudinally oriented side gussets attached to the first and second side edges. Each of the bags has a flat, rectangular bottom formed of lower portions of the front and rear walls and lower portions of the side gussets. Lower corners of the each side gusset are folded outwardly and together to form downward pointing triangular panels. The triangular panels are folded inwardly from the side gussets. Lower portions of the front and rear walls are folded inwardly and sealed together to form the bag bottom. The bag bottom is sealed to the side gussets adjacent upper edges of the triangular panels. The triangular panels are sealed to an upper surface of the bag bottom. Each of the bags is folded inwardly at the side gussets and upwardly from either the front wall or the rear wall at a point spaced upwardly from the bottom edge, to form a flattened bag. The bags are stacked upon one another and held in registration by attachment of the bags to one another, thereby forming a registered bag stack. When the bags are pulled from the bag stack and opened, they will stand erect upon the flat bottom.

(3) In a further variant, a plurality of stacked polyethylene film bags is provided. Each of the bags includes front and rear polyethylene film walls. Each of the front and rear walls has first and second side edges, a top edge and a bottom edge. Each of the bags has a pair of longitudinally oriented side gussets attached to the first and second side edges. Each of the bags has a crease line. The crease line is parallel to the bottom edges and spaced upwardly from the bottom edges by approximately one half of a width of one of the side gussets. Each of the bags is slit from the bottom edges of the walls to the crease line at each intersection of the front and rear walls and the side gussets.

Each of the bags has a flat, rectangular bottom formed of lower portions of the front and rear walls and lower portions of the side gussets. Lower corners of the each side gusset are folded outwardly to the crease line and together to form downward pointing triangular panels. The triangular panels are folded inwardly from the side gussets at the crease line. Lower portions of the front and rear walls are folded inwardly from the crease line and sealed together to form the bag bottom. The bag bottom is sealed to the side gussets adjacent the crease line and upper edges of the triangular panels. The triangular panels is sealed to an upper surface of the bag bottom. Each of the bags is folded inwardly at the side gussets and upwardly from either of the front wall and the rear wall at the crease line, to form a flattened bag. The bags are stacked upon one another and held in registration by attachment of the bags to one another, thereby forming a registered bag stack. When the bags are pulled from the bag stack and opened, they will stand erect upon the flat bottom.

(4) In still a further variant, each of the bags is attached at the top edges of at least one of the front and rear walls to at least one header strip.

(5) (6) In yet a further variant of the invention, the header strip is attached at the top edges of at least one of the front and rear walls by at least one perforation.

(7) (8) In still another variant, the header strip has at least one hole for suspending the bags from a dispensing rack.

(9) (10) In yet another variant, the header strip includes at least one weakened area. The weakened area extends from the hole to an upper edge of the header strip.

(11) In a further variant of the invention, the square bottomed plastic bag stack includes means for attaching an upper portion of the rear wall of a leading one of the bags to an upper portion of the front wall of a subsequent bag in the bag stack. When the leading bag is pulled from the bag stack, the subsequent bag will cause the leading bag to open.

(12) In still a further variant, the means for attaching an upper portion of the rear wall of a leading one of the bags to an upper portion of the front wall of a subsequent bag in the bag stack is selected from the group that includes glue spotting, corona treatment, pressure and corona treatment with pressure.

(13) (14) In another variant, the header strips are attached to one another with at least one hot pin extending through the headers to maintain the bags in registration.

(15) (16) In still another variant of the invention, the header strips are attached to one another with at least one cold stake extending through the headers to maintain the bags in registration.

(17) (18) In yet another variant, at least one handle opening is provided. The handle opening extends through the front and rear walls in an upper portion of each of the bags.

(19) In a further variant, the bags are formed of a porous material.

(20) In still a further variant, the bags are formed of material having microperforations penetrating at least a portion of any of the bag walls and side gussets.

(21) In another variant, the bags have a plurality of ventilating openings penetrating at least a portion of any of the bag walls and side gussets.

(22) In still another variant, an upper seal is provided. The upper seal joins the front wall to the rear wall at the top edges of the bag walls and joins top edges of the side gussets. A U-shaped cutout is provided. The cutout commences at a first point on the upper seal. The first point is spaced from the first side edge and extends downwardly toward the bottom edges, across an upper portion of the bag walls and upwardly to a second point on the upper seal. The second point is spaced from the second side edge, thereby forming an open bag mouth and a pair of bag handles terminating at the upper seal.

(23) In yet another variant, the bags are attached to one another with at least one hot pin extending through the bag handles to maintain the bags in registration.

(24) In yet a further variant, the bags are attached to one another with at least one hot pin extending through the upper portion of the bag walls to maintain the bags in registration.

(25) In still a further variant, the bags are attached to one another with at least one cold stake extending through the bag handles to maintain the bags in registration.

(26) In another variant of the invention, the bags are attached to one another with at least one cold stake extending through the upper portion of the bag walls to maintain the bags in registration.

(27) In yet another variant, the bags further comprise a pair of apertures, each of the apertures penetrating the bag handles at a point spaced downwardly from the upper seal, the apertures permitting the bag stack to be suspended from a dispensing rack.

(28) In still another variant, a central tab is provided. The central tab extends upwardly from at least one of the front wall and the rear wall at the open mouth. The central tab has an opening through it for suspending the bag stack.

(29) In a further variant, the central tab is attached to at least one of the front wall and the rear wall at the open mouth at a weakened area. The weakened area permits the central tab to be torn from the open mouth of the bag as the bag is removed from a dispensing rack.

(30) In still a further variant, the central tab includes a weakened area. The weakened area extends from the opening to an upper edge of the central tab. The weakened area parts under pressure as the bag is removed from a dispensing rack.

(31) In yet a further variant of the invention, at least one header strip is provided. The header strip is attached above the upper seal.

(32) In still another variant, the header strip is attached above the upper seal with at least one perforation.

(33) In still a further variant, the header strip has at least one hole therethrough for suspending the bag stack.

(34) In a further variant, the header strip includes a weakened area. The weakened area extending from the hole to an upper edge of the header strip. The weakened area parting as the bag is removed from a dispensing rack.

(35) A method of making a square bottomed plastic bag stack, includes the following steps. Extruding a tube of polyethylene material. Forming side gussets in the tube and flattening the tube. Cutting the flattened tube perpendicular to the side gussets to a first predetermined length, thereby forming a bag blank. The bag blank has front and rear walls, front and rear top edges, front and rear bottom edges, first and second side edges. Slitting the bag blank at intersections of the side gussets and the front and rear walls from the front and rear bottom edges upwardly for a first predetermined distance. Folding lower corners of the each side gusset outwardly and together to form downward pointing triangular panels. Folding the triangular panels inwardly from the side gussets. Folding lower portions of the front and rear walls inwardly. Sealing the front and rear wall together adjacent the front and rear bottom edges to form a bag bottom. Sealing the bag bottom to the side gussets adjacent upper edges of the triangular panels. Sealing the triangular panels to an upper surface of the bag bottom.

Folding each of the bags inwardly at the side gussets and upwardly from either of the front wall and the rear wall at a point spaced upwardly from the bottom edge, to form a flattened bag. Stacking a plurality of the bag blanks in registration to form a bag stack.

(36) A variant of the method of making a square bottomed plastic bag stack, includes the following steps. Extruding a tube of polyethylene material. Forming side gussets in the tube and flattening the tube. Cutting the flattened tube perpendicular to the side gussets to a first predetermined length, thereby forming a bag blank. The bag blank has front and rear walls, front and rear top edges, front and rear bottom edges, first and second side edges. Forming a crease line in each of the bag blanks. The crease line is parallel to the bottom edges and spaced upwardly from the bottom edges by approximately one half of a width of one of the side gussets. Slitting each of the bag blanks from the bottom edges of the walls to the crease line at each intersection of the front and rear walls and the side gussets. Folding lower corners of the each side gusset outwardly to the crease line and together to form downward pointing triangular panels. Folding the triangular panels inwardly from the side gussets at the crease line. Folding lower portions of the front and rear walls inwardly from the crease line. Sealing the front and rear wall together adjacent the front and rear bottom edges to form a bag bottom. Sealing the bag bottom to the side gussets adjacent the crease line and upper edges of the triangular panels. Sealing the triangular panels to an upper surface of the bag bottom. Folding each of the bag blanks inwardly at the side gussets and upwardly from either of the front wall and the rear wall at the crease line, to form a flattened bag. Stacking a plurality of the bag blanks in registration to form a bag stack.

(37) A further variant of the method of making a square bottomed plastic bag stack includes the following steps. Prior to stacking the bag blanks, perforating the bag blank at a perforation line, the perforation line located at a second predetermined distance from the front and rear top edges. Cutting the bag stack above the perforation line to form a plurality of bag stack header strips. Attaching the header strips to one another to maintain the bags in registration. When the bags are pulled from the bag stack and opened, they will stand erect upon the flat bottom.

(38) A still further variant of the method of making a square bottomed plastic bag stack includes the following step of cutting at least one hole in the header strips for suspending the bags from a dispensing rack.

(39) Yet a further variant of the method of making a square bottomed plastic bag stack includes the step of forming at least one weakened area. The weakened area extends from the hole to an upper edge of the header strip.

(40) Still a further variant of the method of making a square bottomed plastic bag stack includes the step of attaching an upper portion of the rear wall of a leading one of the bags to an upper portion of the front wall of a subsequent bag in the bag stack. When the leading bag is pulled from the bag stack, the subsequent bag will cause the leading bag to open.

(41) Another variant of the method of making a square bottomed plastic bag stack includes the step of providing a means for attaching an upper portion of the rear wall of a leading one of the bags to an upper portion of the front wall of a subsequent bag in the bag stack. The means are selected from the following group that includes glue spotting, corona treatment, pressure and corona treatment with pressure.

(42) Still another variant of the method of making a square bottomed plastic bag stack includes the step of driving at least one hot pin through the headers to maintain the bags in registration.

(43) Yet another variant of the method of making a square bottomed plastic bag stack includes the step of driving at least one cold stake through the headers to maintain the bags in registration.

(44) A further variant of the method of making a square bottomed plastic bag stack includes the step of cutting at least one handle opening in the bag stack. The handle opening extends through the front and rear walls in an upper portion of each of the bags.

(45) Still a further variant of the method of making a square bottomed plastic bag stack includes the step of forming the bags of a porous material.

(46) Yet a further variant of the method of making a square bottomed plastic bag stack includes the step of forming microperforations penetrating at least a portion of any of the bag walls and side gussets.

(47) Still a further variant of the method of making a square bottomed plastic bag stack includes the step of forming a plurality of ventilating opening penetrating at least a portion of any of the bag walls and side gussets.

(48) Another variant of the method of making a square bottomed plastic bag stack includes the following steps. Prior to stacking the bag blanks, joining the front wall to the rear wall at the top edges of the bag walls and joining top edges of the side gussets, thereby forming an upper seal. Forming a U-shaped cutout. The cutout commences at a first point on the upper seal spaced from the first side edge and extends downwardly toward the bottom edges, across an upper portion of the bag walls and upward to a second point on the upper seal spaced from the second side edge, thereby forming an open bag mouth and a pair of bag handles terminating at the upper seal.

(49) Still another variant of the method of making a square bottomed plastic bag stack includes the step of driving at least one hot pin through the upper portion of the bag walls to maintain the bags in registration.

(50) A further variant of the method of making a square bottomed plastic bag stack includes the step of driving at least one hot pin through the bag handles to maintain the bags in registration.

(51) Yet a further variant of the method of making a square bottomed plastic bag stack includes the step of driving at least one cold stake through the upper portion of the bag walls to maintain the bags in registration.

(52) Still a further variant of the method of making a square bottomed plastic bag stack includes the step of driving at least one cold stake through the bag handles to maintain the bags in registration.

(53) Another variant of the method of making a square bottomed plastic bag stack includes the step of cutting a pair of apertures. Each of the apertures penetrate the bag handles at a point spaced downwardly from the upper seal. The apertures permit the bag stack to be suspended from a dispensing rack.

(54) Still another variant of the method of making a square bottomed plastic bag stack includes the step of forming a central tab. The central tab extends upwardly from at least one of the front wall and the rear wall at the open mouth. The central tab has an opening through it for suspending the bag stack.

(55) Yet another variant of the method of making a square bottomed plastic bag stack includes the step of forming a weakened area. The weakened area attaches the central tab to at least one of the front wall and the rear wall at the open mouth. The weakened area permits the central tab to be torn from the open mouth of the bag as the bag is removed from a dispensing rack.

(56) A further variant of the method of making a square bottomed plastic bag stack includes the step of forming the central tab with a weakened area. The weakened area extends from the opening to an upper edge of the central tab. The weakened area parts under pressure as the bag is removed from a dispensing rack.

(57) Still a further variant of the method of making a square bottomed plastic bag stack includes the step of attaching a header strip above the upper seal.

(58) Yet a further variant of the method of making a square bottomed plastic bag stack includes the step of attaching the header strip above the upper seal with at least one perforation.

(59) Another variant of the method of making a square bottomed plastic bag stack includes the step of cutting at least one hole through the header strip for suspending the bag stack.

(60) A final variant of the method of making a square bottomed plastic bag stack includes the step of forming a weakened area. The weakened area extends from the opening to an upper edge of the header strip. The weakened area parts as the bag is removed from a dispensing rack.

An appreciation of the other aims and objectives of the present invention and an understanding of it may be achieved by referring to the accompanying drawings and the detailed description of a preferred embodiment.

DESCRIPTION OF THE DRAWINGS

FIG. 4 is a perspective view of a second embodiment of bag formed from a section of gusseted tubing illustrating slitting of lower corners of the tube;

FIG. 5 is a perspective view of the FIG. 4 embodiment illustrating the outward folding of lower ends of the side gussets to form triangular portions;

FIG. 6 is a perspective view of the FIG. 4 embodiment illustrating the inward folding of the triangular portions of the FIG. 5 embodiment;

FIG. 7 is a perspective view of the FIG. 4 embodiment illustrating a bag bottom formed from lower portions of the front and rear bag walls secured to each other and the ends of the side gussets;

FIG. 22 is a perspective view of an apparatus for forming the bags of the FIG. 4 embodiment including gusseting and slitting the extruded tubing;

FIG. 23 is a perspective view of the method of folding the lower ends of the bag gussets outwardly to form triangular portions;

FIG. 24 is a perspective view of the method of folding the triangular portions inwardly as part of the bag bottom;

FIG. 25 a perspective view of the method of folding the front and rear bag walls over the triangular portions and fastening them to each other, the triangular portions and the side gussets to form the bag bottom;

FIG. 26 is a bottom side view of the assembled bag illustrating the bottom and side seams;

DETAILED DESCRIPTION OF THE PREFERRED EMBODIMENT (1) FIG. 9 illustrates a square bottomed plastic bag stack 10 providing the desired features that may be constructed from the following components. A plurality of stacked polyethylene film bags 15 is provided. As illustrated in FIGS. 1–3, each of the bags 15 includes front 20 and rear 25 polyethylene film walls. Each of the front 20 and rear 25 walls have first 30 and second 35 side edges, a top edge 40 and a bottom edge 45. Each of the bags 15 has a pair of longitudinally oriented side gussets 50 attached to the first 30 and second 35 side edges. Each of the bags 15 has a flat, rectangular bottom 55 formed of lower portions 60 of the front 20 and rear 25 walls and lower portions 65 of the side gussets 50. As illustrated in FIGS. 8 and 9, each of the bags 15 is folded inwardly at the side gussets 50 and upwardly from either the front wall 20 or the rear wall 25 at a point 70 spaced upwardly from the bottom edge 45, to form a flattened bag 15. The bags 15 are stacked upon one another and held in registration by attachment of the bags 15 to one another, thereby forming a registered bag stack 10. As illustrated in FIGS. 10–12, each of the bags 15 is attached at the top edges 40 of at least one of the front 20 and rear 25 walls to at least one header strip 75. When the bags 15 are pulled from the bag stack 10 and opened, they will stand erect upon the flat bottom 55.

(2) In a variant of the invention, as illustrated in FIGS. 4–7, a plurality of stacked polyethylene film bags 15 is provided. Each of the bags 15 includes front 20 and rear 25 polyethylene film walls. Each of the front 20 and rear 25 walls has first 30 and second 35 side edges, a top edge 40 and a bottom edge 45. Each of the bags 15 has a pair of longitudinally oriented side gussets 50 attached to the first 30 and second 35 side edges. Each of the bags 15 has a flat, rectangular bottom 55 formed of lower portions 60 of the front 20 and rear 25 walls and lower portions 65 of the side gussets 50. As illustrated in FIG. 5, lower corners 80 of the each side gusset 50 are folded outwardly and together to form downward pointing triangular panels 85. As illustrated in FIG. 6, the triangular panels 85 are folded inwardly from the side gussets 50. Lower portions 60 of the front 20 and rear 25 walls are folded inwardly and sealed together to form the bag bottom 55. As illustrated in FIGS. 8 and 9, the bag bottom 55 is sealed to the side gussets 50 adjacent upper edges 90 of the triangular panels 85. The triangular panels 85 are sealed to an upper surface 95 of the bag bottom 55. Each of the bags 15 is folded inwardly at the side gussets 50 and upwardly from either the front wall 20 or the rear wall 25 at a point 70 spaced upwardly from the bottom edge 45, to form a flattened bag 15. The bags 15 are stacked upon one another and held in registration by attachment of the bags 15 to one another, thereby forming a registered bag stack 10. When the bags 15 are pulled from the bag stack 10 and opened, they will stand erect upon the flat bottom 55.

Figure 1:
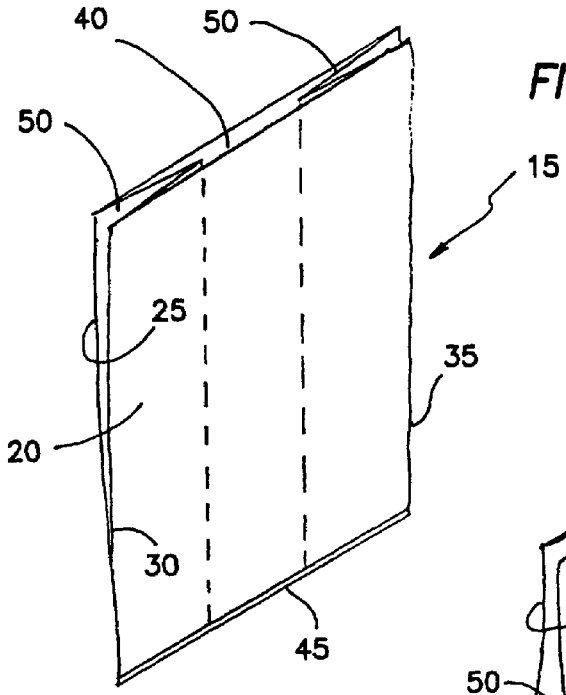
FIG. 1 is a perspective view of a gusseted open mouth bag with bottom seal.
Figure 2:
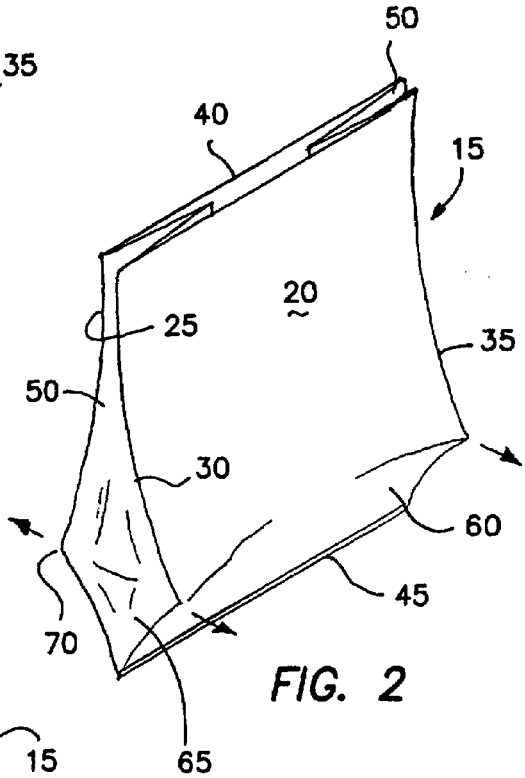
FIG. 2 is a perspective view of the FIG. 1 embodiment with the bag sides pulled outwardly to form bottom edges.
Figure 3:
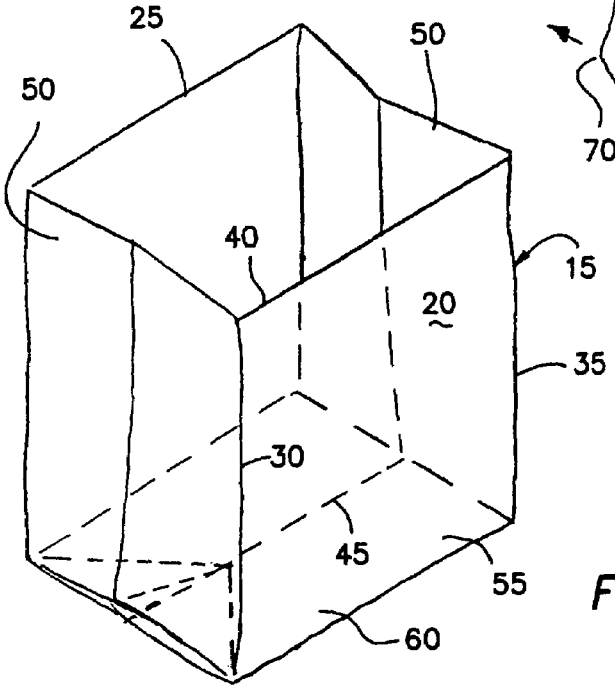
FIG. 3 is a perspective view of the FIG. 1 embodiment illustrating a flattened bag bottom.

(3) In a further variant, as illustrated in FIGS. 4–7, a plurality of stacked polyethylene film bags 15 is provided. Each of the bags 15 includes front 20 and rear 25 polyethylene film walls. Each of the front 20 and rear 25 walls has first 30 and second 35 side edges, a top edge 40 and a bottom edge 45. Each of the bags 15 has a pair of longitudinally oriented side gussets 50 attached to the first 30 and second 35 side edges. Each of the bags 15 has a crease line 100. The crease line 100 is parallel to the bottom edges 45 and spaced upwardly from the bottom edges 45 by approximately one half of a width 105 of one of the side gussets 50. Each of the bags 15 is slit from the bottom edges 45 of the walls 20, 25 to the crease line 100 at each intersection of the front 20 and rear 25 walls and the side gussets 50.

Each of the bags 15 has a flat, rectangular bottom 55 formed of portions of the front 20 and rear 25 walls and portions of the side gussets 50. Lower corners 80 of the each side gusset 50 are folded outwardly to the crease line 100 and together to form downward pointing triangular panels 85. The triangular panels 85 are folded inwardly from the side gussets 50 at the crease line 100. Lower portions 60 of the front 20 and rear 25 walls are folded inwardly from the crease line 100 and sealed together to form the bag bottom 55. The bag bottom 55 is sealed to the side gussets 50 adjacent the crease line 100 and upper edges 90 of the triangular panels 85. The triangular panels 85 are sealed to an upper surface 95 of the bag bottom 55. Each of the bags 15 is folded inwardly at the side gussets 50 and upwardly from either of the front wall 20 and the rear wall 25 at the crease line 100, to form a flattened bag 15. The bags 15 are stacked upon one another and held in registration by attachment of the bags 15 to one another, thereby forming a registered bag stack 10. When the bags 15 are pulled from the bag stack 10 and opened, they will stand erect upon the flat bottom 55.

Figure 10:
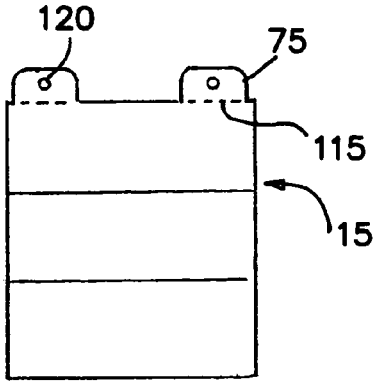
FIG. 10 is a front elevational view of a third embodiment illustrating a header attached at a perforation line.
Figure 11:
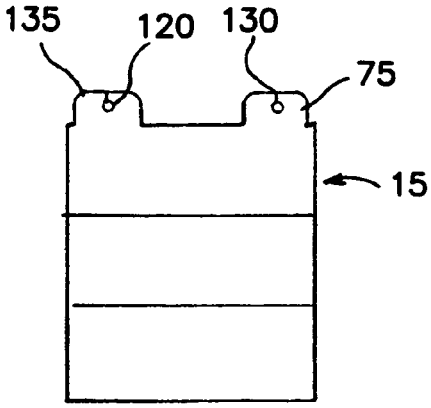
FIG. 11 is a front elevational view of a fourth embodiment illustrating a header having weakened areas in the hanging openings.
Figure 12:
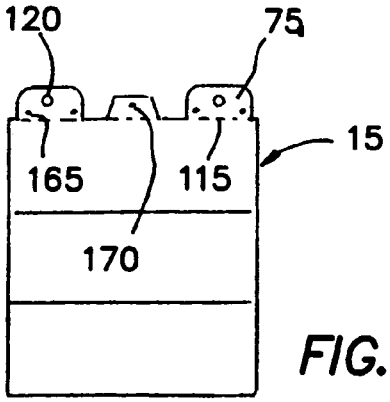
FIG. 12 is a front elevational view of a fifth embodiment illustrating a header attached at a perforation line, having a center tab and cold stakings or hot pinnings registering the bag pack.

(4) In still a further variant, as illustrated in FIGS. 10–12, each of the bags 15 is attached at the top edges 40 of at least one of the front 20 and rear 25 walls to at least one header strip 75.

(5) (6) In yet a further variant of the invention, as illustrated in FIGS. 10 and 12, the header strip 75 is attached at the top edges 40 of at least one of the front 20 and rear 25 walls by at least one perforation 115.

(7) (8) In still another variant, as illustrated in FIGS. 10–13, the header strip 75 has at least one hole 120 for suspending the bags 15 from a dispensing rack 125.

(9) (10) In yet another variant, as illustrated in FIG. 11, the header strip 75 includes at least one weakened area 130. The weakened area 130 extends from the hole 120 to an upper edge 135 of the header strip 75.

Figure 13:
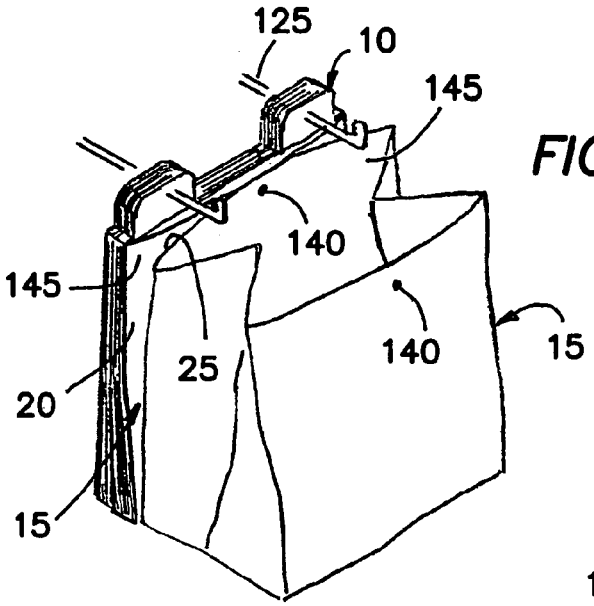
FIG. 13 is a perspective view of the FIG. 10 embodiment illustrating the bag pack on a dispensing rack and glue spots adhering the bags together.

(11) In a further variant of the invention, as illustrated in FIG. 13, the square bottomed plastic bag stack 10 includes means 140 for attaching an upper portion 145 of the rear wall 25 of a leading one of the bags 15 to an upper portion 145 of the front wall 20 of a subsequent bag 15 in the bag stack 10. When the leading bag 15 is pulled from the bag stack 10, the subsequent bag 15 will cause the leading bag 15 to open.

Figures 27, 28, 29, 30:
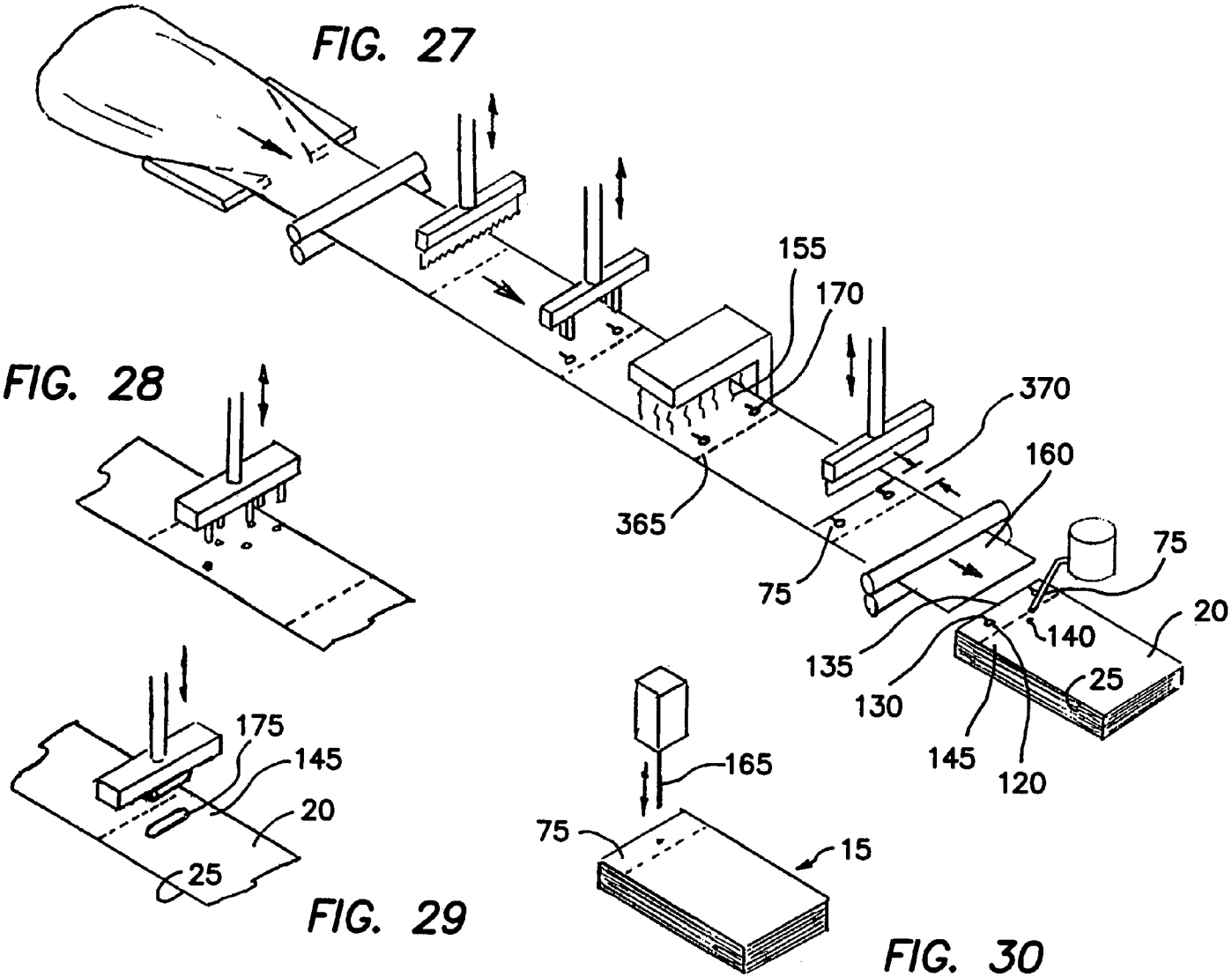
FIG. 27 is a perspective view of the method of forming the FIG. 11 embodiment of a headered bag with attaching glue spots.
FIG. 28 is a perspective view of a method of adding vent holes to the bag walls as in the FIG. 15 embodiment.
FIG. 29 is a perspective view of a method of adding handleholes to the bag walls as in the FIG. 14 embodiment.
FIG. 30 is a perspective view of a method of using a hot pin to the bag walls to one another as in the FIG. 12 embodiment.

(12) In still a further variant, as illustrated in FIG. 27, the means 140 for attaching an upper portion 145 of the rear wall 25 of a leading one of the bags 15 to an upper portion 145 of the front wall 20 of a subsequent bag 15 in the bag stack 10 is selected from the group that includes glue spotting 150, corona treatment 155, pressure 160 and corona treatment with pressure.

(13) (14) In another variant, as illustrated in FIG. 12, the header strips 75 are attached to one another with at least one hot pin 165 extending through the headers 75 to maintain the bags 15 in registration.

(15) (16) In still another variant of the invention, as illustrated in FIG. 12, the header strips 75 are attached to one another with at least one cold stake 170 extending through the headers 75 to maintain the bags 15 in registration.

Figure 14:
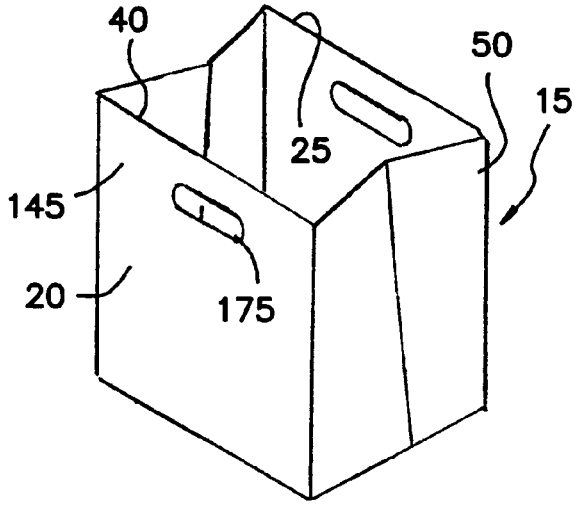
FIG. 14 is a perspective view of the FIG. 4 embodiment illustrating a bag with central handles.

(17) (18) In yet another variant, as illustrated in FIG. 14, at least one handle opening 175 is provided. The handle opening 175 extends through the front 20 and rear 25 walls in an upper portion 145 of each of the bags 15.

(19) In a further variant, the bags 15 are formed of a porous material (not shown).

Figure 15:
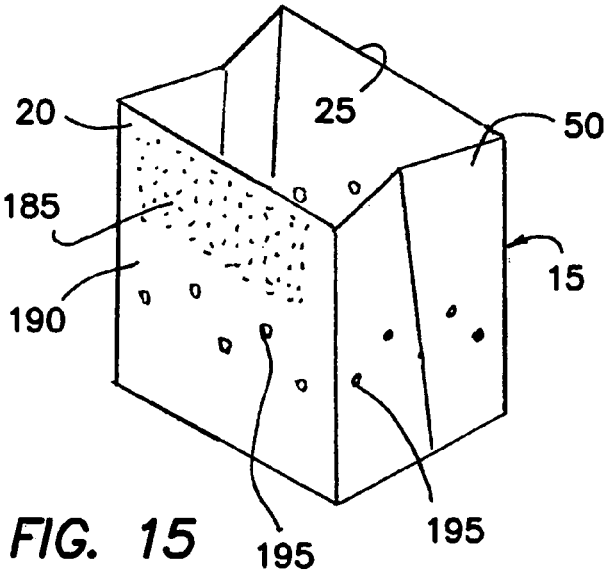
FIG. 15 is a perspective view of the FIG. 4 embodiment illustrating a bag with microperforations in the front and rear bag walls and the gussets.

(20) In still a further variant, as illustrated in FIG. 15, the bags 15 are formed of material having microperforations 185 penetrating at least a portion 190 of any of the bag walls 20, 25 and side gussets 50.

(21) In another variant, as illustrated in FIG. 15, the bags 15 have a plurality of ventilating openings 195 penetrating at least a portion 190 of any of the bag walls 20, 25 and side gussets 50.

Figure 16:
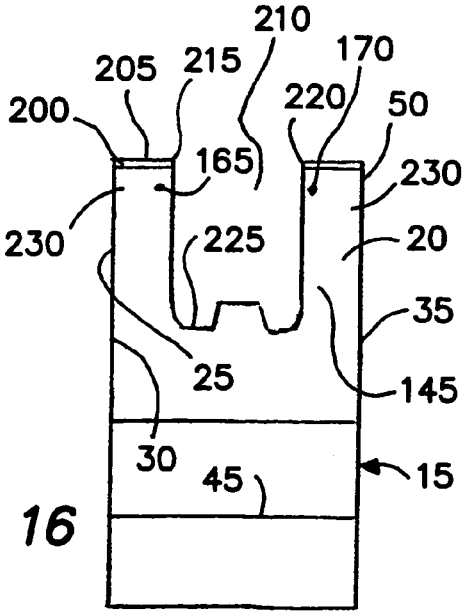
FIG. 16 is a front elevational view of a t-shirt style square bottom bag with center tab.

(22) In still another variant, as illustrated in FIG. 16, an upper seal 200 is provided.

The upper seal 200 joins the front wall 20 to the rear wall 25 at the top edges 40 of the bag walls 20, 25 and joins top edges 205 of the side gussets 50. A U-shaped cutout 210 is provided. The cutout 205 commences at a first point 215 on the upper seal 200. The first point 215 is spaced from the first side edge 30 and extends downwardly toward the bottom edges 45, across an upper portion 145 of the bag walls 20, 25 and upwardly to a second point 220 on the upper seal 200. The second point 220 is spaced from the second side edge 35, thereby forming an open bag mouth 225 and a pair of bag handles 230 terminating at the upper seal 200.

(23) In yet another variant, as illustrated in FIG. 16, the bags 15 are attached to one another with at least one hot pin 165 extending through the bag handles 230 to maintain the bags 15 in registration.

Figure 17:
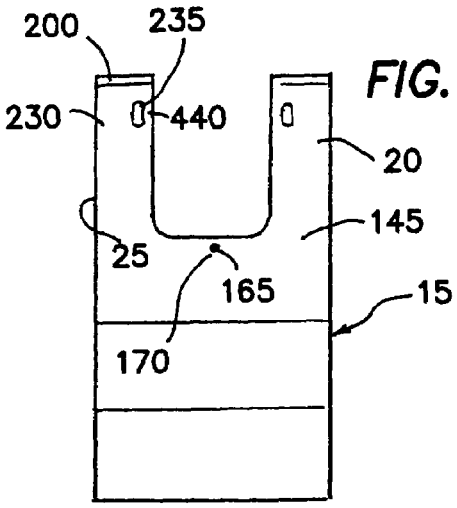
FIG. 17 is a front elevational view of a second embodiment of a t-shirt style square bottom bag having a central glue spot.

(24) In yet a further variant, as illustrated in FIG. 17, the bags 15 are attached to one another with at least one hot pin 165 extending through the upper portion 145 of the bag walls 20, 25 to maintain the bags 15 in registration.

(25) In still a further variant, as illustrated in FIG. 16, the bags 15 are attached to one another with at least one cold stake 170 extending through the bag handles 230 to maintain the bags 15 in registration.

(26) In another variant of the invention, as illustrated in FIG. 17, the bags 15 are attached to one another with at least one cold stake 170 extending through the upper portion 145 of the bag walls 20, 25 to maintain the bags 15 in registration.

(27) In yet another variant, as illustrated in FIG. 17, the bags 15 further comprise a pair of apertures 235, each of the apertures 235 penetrating the bag handles 230 at a point 440 spaced downwardly from the upper seal 200, the apertures 235 permitting the bag stack 10 to be suspended from a dispensing rack 125.

Figure 19:
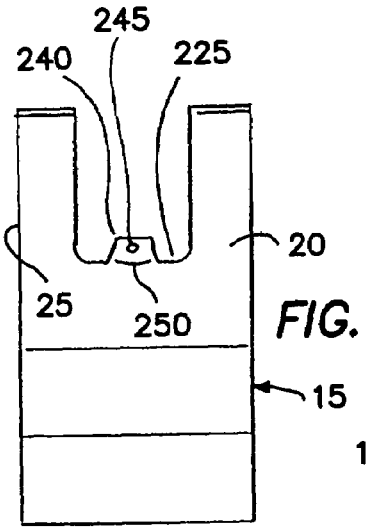
FIG. 19 is a front elevational view of a fourth embodiment of a t-shirt style square bottom bag having a removable center tab joined to the bag with a frangible area.

(28) In still another variant, as illustrated in FIG. 19, a central tab 240 is provided. The central tab 240 extends upwardly from at least one of the front wall 20 and the rear wall 25 at the open mouth 225. The central tab 240 has an opening 245 through it for suspending the bag stack 10.

(29) In a further variant, as illustrated in FIG. 19, the central tab 240 is attached to at least one of the front wall 20 and the rear wall 25 at the open mouth 225 at a weakened area 250. The weakened area 250 permits the central tab 240 to be torn from the open mouth 225 of the bag 15 as the bag 15 is removed from a dispensing rack 125.

Figure 18:
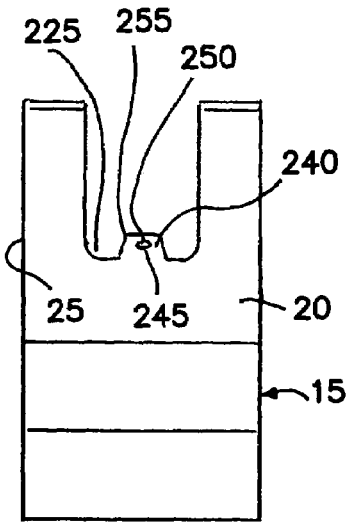
FIG. 18 is a front elevational view of a third embodiment of a t-shirt style square bottom bag having a center tab with a weakened area between the tab opening and the upper edge of the bag mouth.

(30) In still a further variant, as illustrated in FIG. 18, the central tab 240 includes a weakened area 250. The weakened area 250 extends from the opening 245 to an upper edge 255 of the central tab 240. The weakened area 250 parts under pressure as the bag 15 is removed from a dispensing rack 125.

Figure 20:
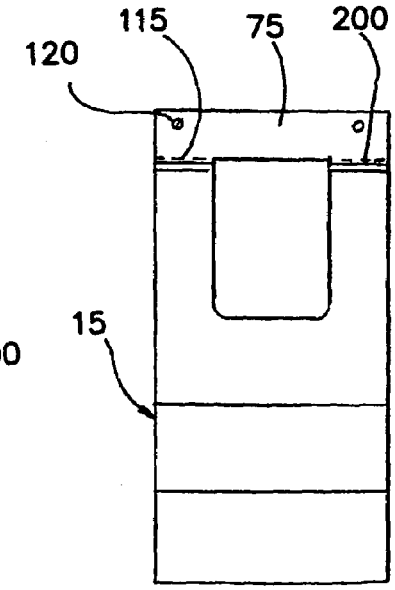
FIG. 20 is a front elevational view of a fifth embodiment of a t-shirt style square bottom bag having a removable header joined to the upper edges of the bag handles with a perforation line.
Figure 21:
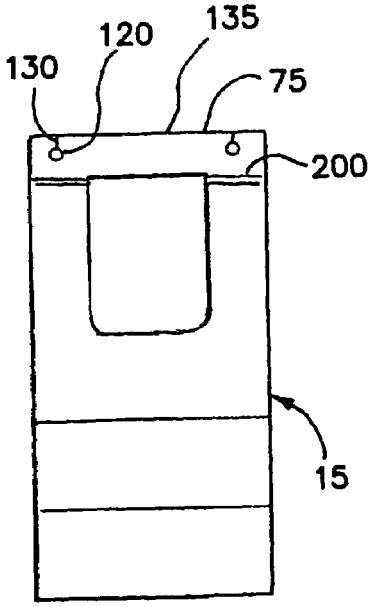
FIG. 21 is a front elevational view of a sixth embodiment of a t-shirt style square bottom bag having a header joined to the upper edges of the bag handles and having weakened areas in the bag support openings.

(31) In yet a further variant of the invention, as illustrated in FIGS. 20 and 21, at least one header strip 75 is provided. The header strip 75 is attached above the upper seal 200.

(32) In still another variant, as illustrated in FIG. 20, the header strip 75 is attached above the upper seal 200 with at least one perforation 115.

(33) In still a further variant, as illustrated in FIGS. 20 and 21, the header strip 75 has at least one hole 120 therethrough for suspending the bag stack 10.

(34) In a further variant, as illustrated in FIG. 21, the header strip 75 includes a weakened area 130. The weakened area 130 extending from the hole 120 to an upper edge 135 of the header strip 75. The weakened area 130 parting as the bag 115 is removed from a dispensing rack 125.

Figure 8:
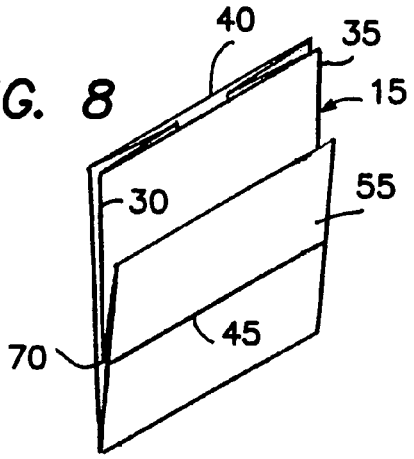
FIG. 8 is a perspective view of the FIG. 4 embodiment illustrating the folding of the bag bottom along side the bag walls.
Figure 9:
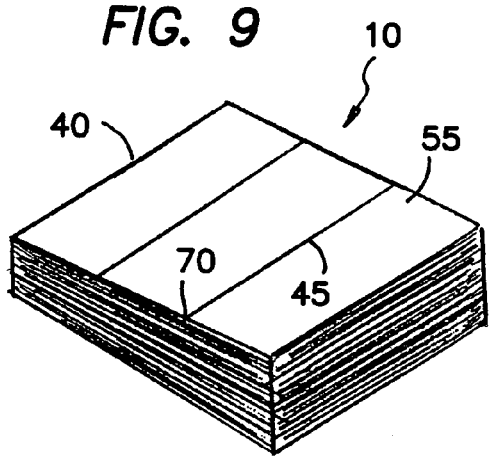
FIG. 9 is a perspective view of a stack of bags of the FIG. 4 embodiment.

(35) In another variant, as illustrated in FIGS. 22–26, a method of making a square bottomed plastic bag stack 10, includes the following steps. Extruding a tube of polyethylene material 260. Forming side gussets 50 in the tube 260 and flattening the tube 260. Cutting the flattened tube 260 perpendicular to the side gussets 50 to a first predetermined length 265, thereby forming a bag blank 270. The bag blank 270 has front 20 and rear 25 walls, front and rear top edges 40, front and rear bottom edges 45, first 30 and second 35 side edges. Slitting the bag blank 270 at intersections 320 of the side gussets 50 and the front 20 and rear 25 walls from the front 45 and rear 45 bottom edges upwardly for a first predetermined distance 325. Folding lower corners 80 of the each side gusset 50 outwardly and together to form downward pointing triangular panels 85. Folding the triangular panels 85 inwardly from the side gussets 50. Folding lower portions 60 of the front 20 and rear 25 walls inwardly, as illustrated in FIG. 8. Sealing the front 20 and rear 25 wall together adjacent the front and rear bottom edges 45 to form a bag bottom 55. Sealing the bag bottom 55 to the side gussets 50 adjacent upper edges 90 of the triangular panels 85. Sealing the triangular panels 85 to an upper surface 95 of the bag bottom 55. Folding each of the bags 15 inwardly at the side gussets 50 and upwardly from either of the front wall 20 and the rear wall 25 at a point 70 spaced upwardly from the bottom edge, 45 to form a flattened bag 15. Stacking a plurality of the bags 15 in registration to form a bag stack 10 as illustrated in FIG. 9.

(36) In yet another variant of the method of making a square bottomed plastic bag stack 10, includes the following steps, as illustrated in FIGS. 22 and 26. Extruding a tube of polyethylene material 260. Forming side gussets 50 in the tube 260 and flattening the tube 260. Cutting the flattened tube 260 perpendicular to the side gussets 50 to a first predetermined length 265, thereby forming a bag blank 270. The bag blank 270 has front 20 and rear 25 walls, front and rear top edges 40, front and rear bottom edges 45, first 30 and second 35 side edges. Forming a crease line 100 in each of the bag blanks 270. The crease line 100 is parallel to the bottom edges 45 and spaced upwardly from the bottom edges 45 by approximately one half of a width 105 of one of the side gussets 50. Slitting each of the bag blanks 270 from the bottom edges 45 of the walls 20, 25 to the crease line 100 at each intersection 320 of the front 20 and rear 25 walls and the side gussets 50. Folding lower corners of the each side gusset 50 outwardly to the crease line 100 and together to form downward pointing triangular panels 85. Folding the triangular panels 85 inwardly from the side gussets 50 at the crease line 100. Folding lower portions 60 of the front 20 and rear 25 walls inwardly from the crease line 100. Sealing the front 20 and rear 25 wall together adjacent the front and rear bottom edges 45 to form a bag bottom 55. Sealing the bag bottom 55 to the side gussets 50 adjacent the crease line 100 and upper edges 90 of the triangular panels 85. Sealing the triangular panels 85 to an upper surface 95 of the bag bottom 55. Folding each of the bag blanks 270 inwardly at the side gussets 50 and upwardly from either of the front wall 20 and the rear wall 25 at the crease line 100, to form a flattened bag 15, as illustrated in FIG. 8. Stacking a plurality of the bags 15 in registration to form a bag stack 10, as illustrated in FIG. 9.

(37) A further variant of the method of making a square bottomed plastic bag stack 10 includes the following steps, as illustrated in FIG. 27. Prior to stacking the bag blanks 270, perforating the bag blank 270 at a perforation line 365, the perforation line 365 located at a second predetermined distance 370 from the front and rear top edges 40. Cutting the bag stack 10 above the perforation line 365 to form a plurality of bag stack header strips 75. Attaching the header strips 75 to one another to maintain the bags 15 in registration, as illustrated in FIG. 30. When the bags 15 are pulled from the bag stack 10 and opened, they will stand erect upon the flat bottom 55.

(38) A still further variant of the method of making a square bottomed plastic bag stack 10 includes the following step of cutting at least one hole 120 in the header strips 110 for suspending the bags 15 from a dispensing rack 125, as illustrated in FIG. 27.

(39) Yet a further variant of the method of making a square bottomed plastic bag stack 10 includes the step of forming at least one weakened area 130. The weakened area 130 extends from the hole 120 to an upper edge 135 of the header strip 75, as illustrated in FIG. 27.

(40) Still a further variant of the method of making a square bottomed plastic bag stack 10 includes the step of attaching an upper portion 145 of the rear wall 25 of a leading one of the bags 15 to an upper portion 145 of the front wall 20 of a subsequent bag 15 in the bag stack 10. When the leading bag 15 is pulled from the bag stack 10, the subsequent bag 15 will cause the leading bag 15 to open, as illustrated in FIG. 27.

(41) Another variant of the method of making a square bottomed plastic bag stack 10 includes the step of providing a means for attaching an upper portion 145 of the rear wall 25 of a leading one of the bags 15 to an upper portion 145 of the front wall 20 of a subsequent bag 15 in the bag stack 10. The means are selected from the following group that includes glue spotting 140, corona treatment 155, pressure 160 and corona treatment with pressure, as illustrated in FIG. 27.

(42) Still another variant of the method of making a square bottomed plastic bag stack 10 includes the step of driving at least one hot pin 165 through the headers 110 to maintain the bags 15 in registration, as illustrated in FIG. 30.

(43) Yet another variant of the method of making a square bottomed plastic bag stack 10 includes the step of driving at least one cold stake 170 through the headers 110 to maintain the bags 15 in registration, as illustrated in FIGS. 12 and 17.

(44) A further variant of the method of making a square bottomed plastic bag stack 10 includes the step of cutting at least one handle opening 175 in the bag blank 270. The handle opening 175 extends through the front 20 and rear 25 walls in an upper portion 145 of each of the bags 15, as illustrated in FIG. 29.

(45) Still a further variant of the method of making a square bottomed plastic bag stack 10 includes the step of forming the bags 15 of a porous material (not shown).

(46) Yet a further variant of the method of making a square bottomed plastic bag stack 10 includes the step of forming microperforations 185 penetrating at least a portion of any of the bag walls 20, 25 and side gussets 50, as illustrated in FIG. 15.

(47) Still a further variant of the method of making a square bottomed plastic bag stack 10 includes the step of forming a plurality of ventilating openings 195 penetrating at least a portion of any of the bag walls 20, 25 and side gussets 50, as illustrated in FIG. 15.

Figure 31:
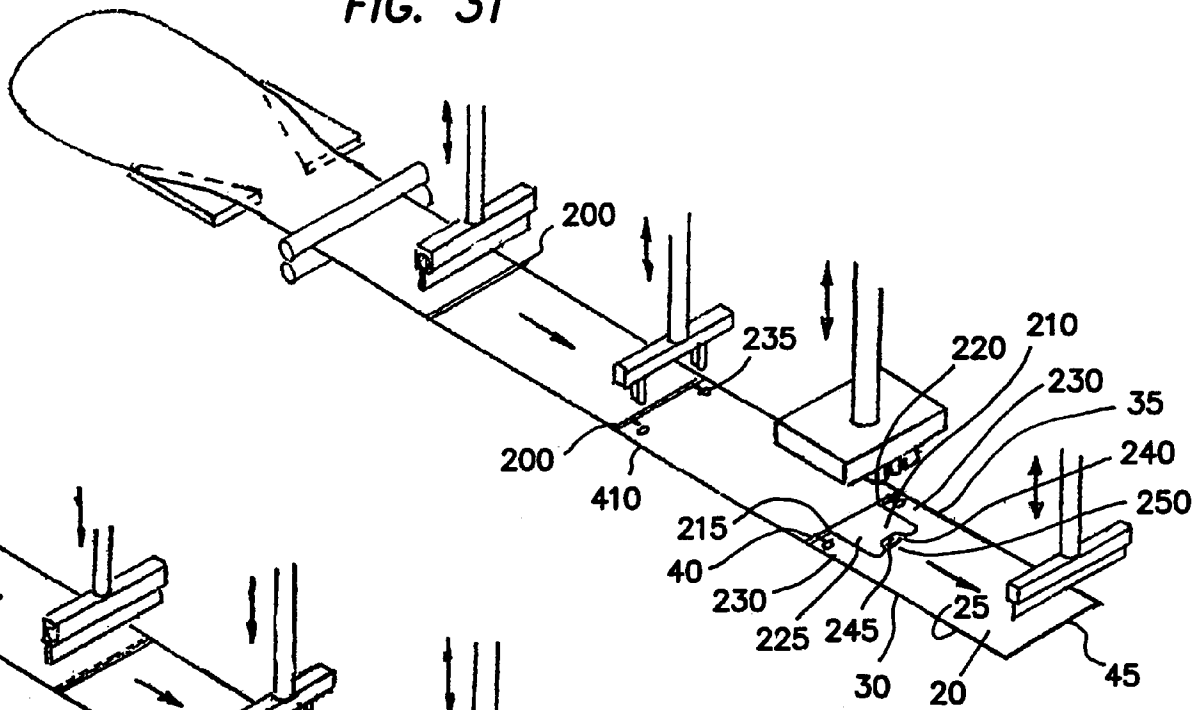
FIG. 31 is a perspective view of a method of forming a gusseted t-shirt style bag as in the FIG. 21 embodiment.

(48) Another variant of the method of making a square bottomed plastic bag stack 10 includes the following steps. Prior to stacking the bag blanks 270, joining the front wall 20 to the rear wall 25 at the top edges 40 of the bag walls 20, 25 and joining top edges 40 of the side gussets 50, thereby forming an upper seal 200. Forming a U-shaped cutout 210. The cutout 210 commences at a first point 215 on the upper seal 200 spaced from the first side edge 30 and extends downwardly toward the bottom edges 45, across an upper portion 145 of the bag walls 20, 25 and upward to a second point 220 on the upper seal 200 spaced from the second side edge 35, thereby forming an open bag mouth 225 and a pair of bag handles 230 terminating at the upper seal 200, as illustrated in FIG. 31.

Figure 33:
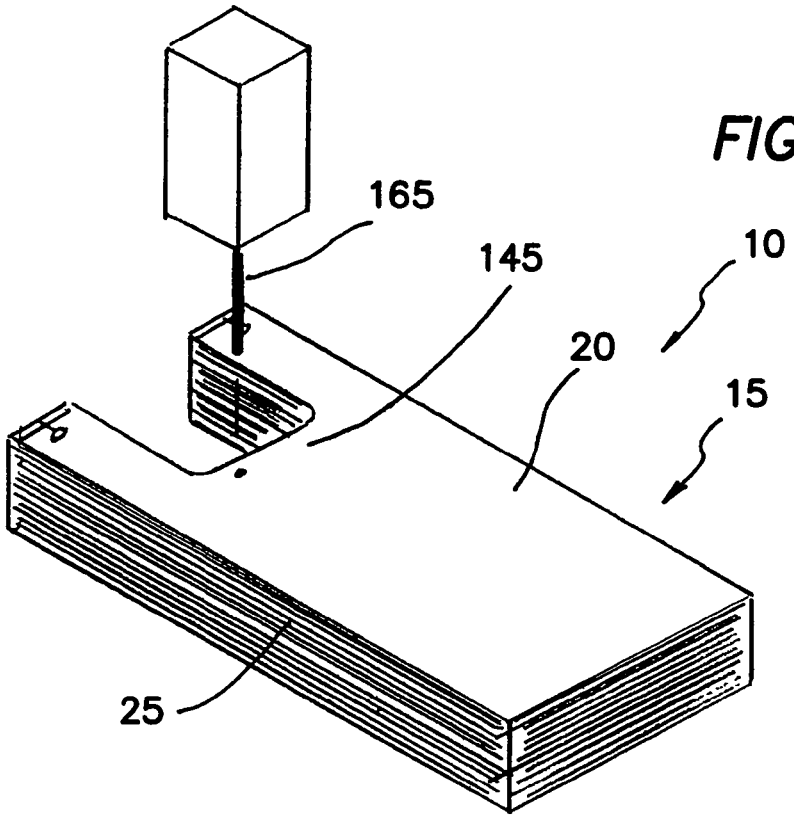
FIG. 33 is a perspective view of a bag stack of square bottom t-shirt style bags being adhered together with a hot pin through an upper portion of the bags.

(49) Still another variant of the method of making a square bottomed plastic bag stack 10 includes the step of driving at least one hot pin 165 through the upper portion 145 of the bag walls 20, 25 to maintain the bags 15 in registration, as illustrated in FIG. 33.

Figure 34:
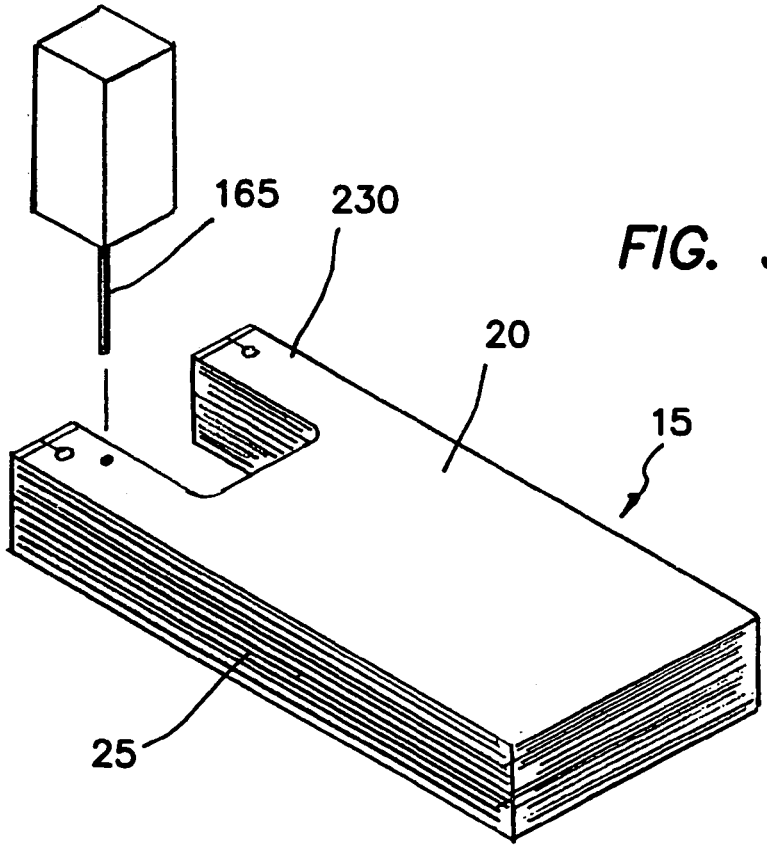
FIG. 34 is a perspective view of a bag stack of square bottom t-shirt style bags being adhered together with a hot pin through the handles of the bags.

(50) A further variant of the method of making a square bottomed plastic bag stack 10 includes the step of driving at least one hot pin 165 through the bag handles 230 to maintain the bags 15 in registration, as illustrated in FIG. 34.

(51) Yet a further variant of the method of making a square bottomed plastic bag stack 10 includes the step of driving at least one cold stake (not shown) through the upper portion of the bag walls 20, 25 to maintain the bags 15 in registration.

(52) Still a further variant of the method of making a square bottomed plastic bag stack 10 includes the step of driving at least one cold stake (not shown) through the bag handles 230 to maintain the bags 15 in registration.

(53) Another variant of the method of making a square bottomed plastic bag stack 10 includes the step of cutting a pair of apertures 235, as illustrated in FIG. 31. Each of the apertures 235 penetrates the bag handles 230 at a point 440 spaced downwardly from the upper seal 200. The apertures permit the bag stack 10 to be suspended from a dispensing rack 125.

(54) Still another variant of the method of making a square bottomed plastic bag stack 10 includes the step of forming a central tab 240, as illustrated in FIG. 31. The central tab 240 extends upwardly from at least one of the front wall 20 and the rear wall 25 at the open mouth 225. The central tab 240 has an opening 245 through it for suspending the bag stack 10.

(55) Yet another variant of the method of making a square bottomed plastic bag stack 10 includes the step of forming a weakened area 250, as illustrated in FIG. 31. The weakened area 250 attaches the central tab 240 to at least one of the front wall 20 and the rear wall 25 at the open mouth 225. The weakened area 250 permits the central tab 240 to be torn from the open mouth 225 of the bag 15 as the bag 15 is removed from a dispensing rack 125.

(56) A further variant of the method of making a square bottomed plastic bag stack 10 includes the step of forming the central tab 240 with a weakened area 250, as illustrated in FIG. 18. The weakened area 250 extends from the opening 245 to an upper edge 255 of the central tab 240. The weakened area 250 parts under pressure as the bag 15 is removed from a dispensing rack 125.

Figure 32:
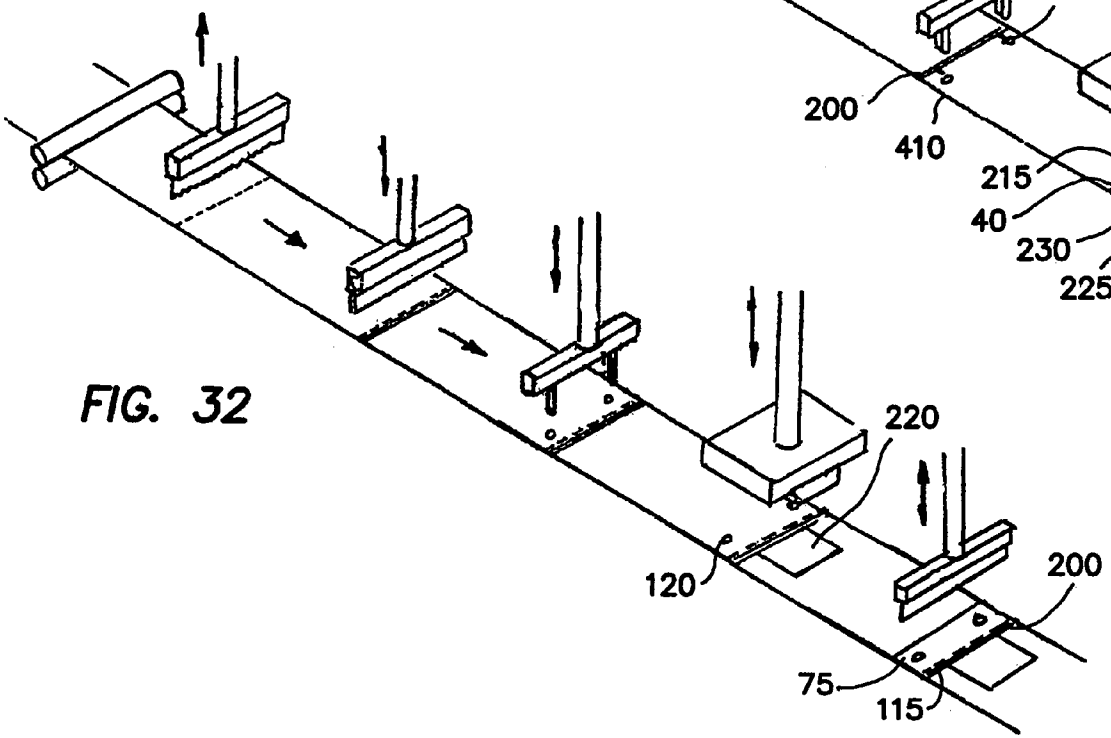
FIG. 32 is a perspective view of a method of forming a headered t-shirt style bag as as in the FIG. 20 embodiment.

(57) Still a further variant of the method of making a square bottomed plastic bag stack 10 includes the step of attaching a header strip 75 above the upper seal 200, as illustrated in FIG. 32.

(58) Yet a further variant of the method of making a square bottomed plastic bag stack 10 includes the step of attaching the header strip 75 above the upper seal 200 with at least one perforation 115, as illustrated in FIG. 32.

(59) Another variant of the method of making a square bottomed plastic bag stack 10 includes the step of cutting at least one hole 120 through the header strip 75 for suspending the bag stack 10, as illustrated in FIG. 32.

(60) A final variant of the method of making a square bottomed plastic bag stack 10 includes the step of forming a weakened area 130, as illustrated in FIG. 11. The weakened area 130 extends from the opening 410 to an upper edge 135 of the header strip 110. The weakened area 130 parts as the bag 15 is removed from a dispensing rack 125.

An appreciation of the other aims and objectives of the present invention and an understanding of it may be achieved by referring to the accompanying drawings and the detailed description of a preferred embodiment.

What is claimed is:

1. A square bottomed plastic bag stack, comprising:

a plurality of stacked polyethylene film bags, each of said bags comprising front and rear polyethylene film walls, each of said front and rear walls having first and second side edges, a top edge and a bottom edge;

each of said bags having a pair of longitudinally oriented side gussets attached to said first and second side edges;

each of said bags having a flat, rectangular bottom formed of lower portions of said front and rear walls and lower portions of said side gussets;

lower corners of said each side gusset being folded outwardly and together to form downward pointing triangular panels;

said triangular panels being folded inwardly from said side gussets;

lower portions of said front and rear walls being folded inwardly and sealed together to form the bag bottom;

said bag bottom being sealed to said side gussets adjacent upper edges of said triangular panels;

said triangular panels being sealed to an upper surface of said bag bottom;

each of said bags being folded inwardly at said side gussets and upwardly from either of said front wall and said rear wall at a point spaced upwardly from said bottom edge, to form a flattened bag;

said bags being stacked upon one another and held in registration by attachment of said bags to one another, thereby forming a registered bag stack; and whereby, when said bags are pulled from said bag stack and opened, they will stand erect upon said flat bottom.

2. A square bottomed header bag stack, comprising:

a plurality of stacked polyethylene film bags, each of said bags comprising front and rear polyethylene film walls, each of said front and rear walls having first and second side edges, a top edge and a bottom edge;

each of said bags having a pair of longitudinally oriented side gussets attached to said first and second side edges;

each of said bags having a crease line, said crease line being parallel to said bottom edges and spaced upwardly from said bottom edges by approximately one half of a width of one of said side gussets;

each of said bags being slit from said bottom edges of said walls to said crease line at each intersection of said front and rear walls and said side gussets;

each of said bags having a flat, rectangular bottom formed of lower portions of said front and rear walls and lower portions of said side gussets;

lower corners of said each side gusset being folded outwardly to said crease line and together to form downward pointing triangular panels;

said triangular panels being folded inwardly from said side gussets at said crease line;

lower portions of said front and rear walls being folded inwardly from said crease line and sealed together to form a bag bottom;

said bag bottom being sealed to said side gussets adjacent said crease line and upper edges of said triangular panels;

said triangular panels being sealed to an upper surface of said bag bottom;

each of said bags being folded inwardly at said side gussets and upwardly from either of said front wall and said rear wall at said crease line, to form a flattened bag;

said bags being stacked upon one another and held in registration by attachment of said bags to one another, thereby forming a registered bag stack; and whereby, when said bags are pulled from said bag stack and opened, they will stand erect upon said flat bottom.

3. The square bottomed plastic bag stack as described in claim 1 or claim 2, wherein each of said bags is attached at said top edges of at least one of said front and rear walls to at least one header strip.

4. The square bottomed plastic bag stack as described in claim 3 wherein said header strip is attached at said top edges of at least one of said front and rear walls by at least one perforation.

5. The square bottomed plastic bag stack as described in claim 3 wherein said header strip has at least one hole for suspending said bags from a dispensing rack.

6. The square bottomed plastic bag stack as described in claim 5 wherein said header strip includes at least one weakened area, said weakened area extending from said hole to an upper edge of said header strip.

7. The square bottomed plastic bag stack as described in claim 1 or claim 2, further comprising:

means for attaching an upper portion of said rear wall of a leading one of said bags to an upper portion of said front wall of a subsequent bag in said bag stack; and whereby, when said leading bag is pulled from said bag stack, said subsequent bag will cause said leading bag to open.

8. The square bottomed plastic bag stack as described in claim 7, wherein said means for attaching an upper portion of said rear wall of a leading one of said bags to an upper portion of said front wall of a subsequent bag in said bag stack is selected from the group comprising:

glue spotting, corona treatment, pressure and corona treatment with pressure.

9. The square bottomed plastic bag stack as described in claim 3, wherein said header strips are attached to one another with at least one hot pin extending through said headers to maintain the bags in registration.

10. The square bottomed plastic bag stack as described in claim 3, wherein said header strips are attached to one another with at least one cold stake extending through said headers to maintain the bags in registration.

11. The square bottomed plastic bag stack as described in claim 3, further comprising at least one handle opening, said handle opening extending through said front and rear walls in an upper portion of each of said bags.

12. The square bottomed plastic bag stack as described in claim 1 or claim 2, wherein said bags are formed of a porous material.

13. The square bottomed plastic bag stack as described in claim 1 or claim 2, wherein said bags are formed of material having microperforations penetrating at least a portion of any of said bag walls and side gussets.

14. The square bottomed plastic bag stack as described in claim 1 or claim 2, wherein said bags have a plurality of ventilating openings penetrating at least a portion of any of said bag walls and side gussets.

15. The square bottomed plastic bag stack as described in claim 1 or claim 2, wherein said bags further comprise:

an upper seal, said upper seal joining said front wall to said rear wall at said top edges of said bag walls and joining top edges of said side gussets; and a U-shaped cutout, said cutout commencing at a first point on said upper seal spaced from said first side edge and extending downwardly toward said bottom edges, across an upper portion of said bag walls and upwardly to a second point on said upper seal spaced from said second side edge, thereby forming an open bag mouth and a pair of bag handles terminating at said upper seal.

16. The square bottomed plastic bag stack as described in claim 15, wherein said bags are attached to one another with at least one hot pin extending through said bag handles to maintain said bags in registration.

17. The square bottomed plastic bag stack as described in claim 15, wherein said bags are attached to one another with at least one hot pin extending through said upper portion of said bag walls to maintain said bags in registration.

18. The square bottomed plastic bag stack as described in claim 15, wherein said bags are attached to one another with at least one cold stake extending through said bag handles to maintain said bags in registration.

19. The square bottomed plastic bag stack as described in claim 15, wherein said bags are attached to one another with at least one cold stake extending through said upper portion of said bag walls to maintain said bags in registration.

20. The square bottomed plastic bag stack as described in claim 15, wherein said bags further comprise a pair of apertures, each of said apertures penetrating said bag handles at a point spaced downwardly from said upper seal, said apertures permitting said bag stack to be suspended from a dispensing rack.

21. The square bottomed plastic bag stack as described in claim 15, further comprising:

a central tab, said central tab extending upwardly from at least one of said front wall and said rear wall at said open mouth; and said central tab having an opening therethrough for suspending said bag stack.

22. The square bottomed plastic bag stack as described in claim 21, wherein said central tab is attached to at least one of said front wall and said rear wall at said open mouth at a weakened area, said weakened area permitting said central tab to be tom from said open mouth of said bag as said bag is removed from a dispensing rack.

23. The square bottomed plastic bag stack as described in claim 21, wherein said central tab includes a weakened area, said weakened area extending from said opening to an upper edge of said central tab, said weakened area parting under pressure as said bag is removed from a dispensing rack.

24. The square bottomed plastic bag stack as described in claim 15, further comprising at least one header strip, said header strip being attached above said upper seal.

25. The square bottomed plastic bag stack as described in claim 24, wherein said header strip is attached above said upper seal with at least one perforation.

26. The square bottomed plastic bag stack as described in claim 24, wherein said header strip has at least one hole therethrough for suspending said bag stack.

27. The square bottomed plastic bag stack as described in claim 26, wherein said header strip includes a weakened area, said weakened area extending from said hole to an upper edge of said header strip, said weakened area parting as said bag is removed from a dispensing rack.

* * * * *